US009861218B1

(12) United States Patent
Matula

(10) Patent No.: US 9,861,218 B1
(45) Date of Patent: Jan. 9, 2018

(54) VASE BRACE

(71) Applicant: Catherine Matula, Mount Prospect, IL (US)

(72) Inventor: Catherine Matula, Mount Prospect, IL (US)

( * ) Notice: Subject to any disclaimer, the term of this patent is extended or adjusted under 35 U.S.C. 154(b) by 0 days.

(21) Appl. No.: 15/680,444

(22) Filed: Aug. 18, 2017

(51) Int. Cl.
*A47G 7/07* (2006.01)

(52) U.S. Cl.
CPC ..... *A47G 7/07* (2013.01)

(58) Field of Classification Search
CPC ..... A47G 7/02; A47G 7/025; A47G 7/07
USPC ..... 47/41.01, 41.11, 41.13
See application file for complete search history.

(56) References Cited

U.S. PATENT DOCUMENTS

| | | | | |
|---|---|---|---|---|
| 1,616,894 | A | 2/1927 | Finlayson | |
| 2,126,766 | A | 8/1938 | Joseph | |
| D194,506 | S * | 2/1963 | Laan | D11/147 |
| 3,447,262 | A | 6/1969 | Uhl | |
| 5,347,752 | A | 9/1994 | Black | |
| 5,758,452 | A | 6/1998 | Metteucci et al. | |
| 6,189,261 | B1 | 2/2001 | Helgeson | |
| D526,595 | S * | 8/2006 | Taddeo | D11/147 |
| 7,263,800 | B2 * | 9/2007 | Taddeo | A47G 7/07 47/41.11 |
| 2001/0034972 | A1 * | 11/2001 | Masters | A01G 5/04 47/58.1 CF |
| 2002/0184818 | A1 | 12/2002 | Roskin | |
| 2003/0009937 | A1 | 1/2003 | Delaney | |
| 2006/0096171 | A1 | 5/2006 | Taddeo et al. | |

OTHER PUBLICATIONS

Mud Pie 4435002 Preserve Mason Jar Vase, Brown, https://www.amazon.com/Mud-Pie-4435002-Preserve-Mason/dp/B00UW74JR6.

* cited by examiner

*Primary Examiner* — David J Parsley
*Assistant Examiner* — Danielle A Clerkley
(74) *Attorney, Agent, or Firm* — Lesley A. Wallerstein, LLC

(57) ABSTRACT

A brace for invisibly supporting flowers and other decorative floral elements in the center of an opening of a vase of any circumference.

9 Claims, 11 Drawing Sheets

VASE BRACE

CROSS-REFERENCE TO RELATED APPLICATION (not applicable)

STATEMENT REGARDING FEDERALLY SPONSORED RESEARCH OR DEVELOPMENT (not applicable)

NAMES OF PARTIES TO A JOINT RESEARCH AGREEMENT (not applicable)

REFERENCE TO SEQUENCE LISTING, A TABLE OR A COMPUTER PROGRAM LISTING COMPACT DISC APPENDIX (not applicable)

FIELD OF THE INVENTION

This invention relates to an apparatus for invisibly positioning and stabilizing flower stems or other vertical decorative elements in vases of any diameter.

BACKGROUND OF THE INVENTION

As complicated as our lives have become, we still turn to flowers to express ourselves. Flowers mark milestone events, tell us of the seasons and make our homes more beautiful, inside and out. Flowers come in a variety of shapes, sizes and colors. So do the vases which hold them. Vases can be tall, short, narrow, wide, glass, terra cotta, glazed or painted. Flowers arranged in vases evoke infinitely many moods and attitudes. To the Japanese, arranging flowers is a highly disciplined art, requiring years of formal schooling.

This may be out of reach for most people who appreciate flowers but do not necessarily want to invest the time to study this art. They either pay a professional florist or improvise with what they have on hand. Florists stock a variety of vases, flowers and flower-stabilizing accessories. They have an eye for knowing which color goes where. They have the tools to keep the arrangement looking professional. Arranging flowers yourself is less expensive, but does not always look professional. The vase might be too wide for the number of flowers, and the flowers fall to the perimeter of the vase. Certain flowers shift position, changing the overall shape of the arrangement. In this art, what is needed is a way for a person without special training to create a professional and stable flower arrangement, regardless of the size of the vase.

I have created a two-part brace that selectively and invisibly attaches to the sidewalls of a vase opening of any circumference. The first part comprises a lower ring of transparent material. The ring can be a polygon with any number of sides. It can also be a circle. In a preferred embodiment, the lower ring has eight sides. In this preferred embodiment, every other side of the polygonal ring has a spool installed thereon. Each of these four spools is wound with, and dispenses, clear adhesive tape. The tape is coated with adhesive on an underside, which faces down toward a bottom of the vase, and a non-adhesive top side. A length of tape is pulled radially away from the lower ring and affixed to the sidewall of the vase.

The lower ring is suspended over the opening of a vase. The vase is selected to be a larger diameter than the lower ring. In the preferred embodiment, each of the four lengths of tape is pulled to dispense a length of tape long enough to reach just over an edge of the opening of the vase. If the opening of the vase represents a clock, there would be tape radiating from 3 o'clock, 6 o'clock, 9 o'clock and 12 o'clock. In this way, the tape holds the lower ring over the center of the vase. When the tape is deployed in this way, the lower ring creates grid lines which subdivide the opening of the vase into five compartments: a center compartment, and four peripheral compartments within the opening of the vase. The grid is preferably centered within and coplanar with, the opening of the vase.

The second part comprises an upper ring. This upper ring has a diameter larger than the lower ring but smaller than the opening of the vase. The upper ring has a lower surface, which has adhesive dots disposed thereon, and an upper surface, which is free of adhesive. The adhesive dots secure the upper ring to the non-adhesive side of the tape crossing the opening of the vase. The number of adhesive dots corresponds to the number and radial position of the deployed tape. For example, if there is tape radiating from a 3 o'clock, 6 o'clock, 9 o'clock and 12 o'clock positions, there will be 4 adhesive dots affixed to the underside of the upper ring at those same positions. Placing the upper ring on the lower ring in this way creates additional grid lines, thereby subdividing the opening of the vase into a total of nine compartments. Changing the number of spools will change the number of total compartments created by the vase brace. Preferably, the upper ring is a floret shape, but it may be designed in alternative shapes such as a star, a circle, oval or any other shape that has a general diameter between the lower ring and the perimeter of the vase.

Preferably, the lower ring, the spools and the upper ring are made of a transparent thermoplastic, but other transparent materials can be used. Preferably, the tape is transparent as well, to make the vase brace nearly invisible.

REFERENCE NUMERALS

Figure 1:
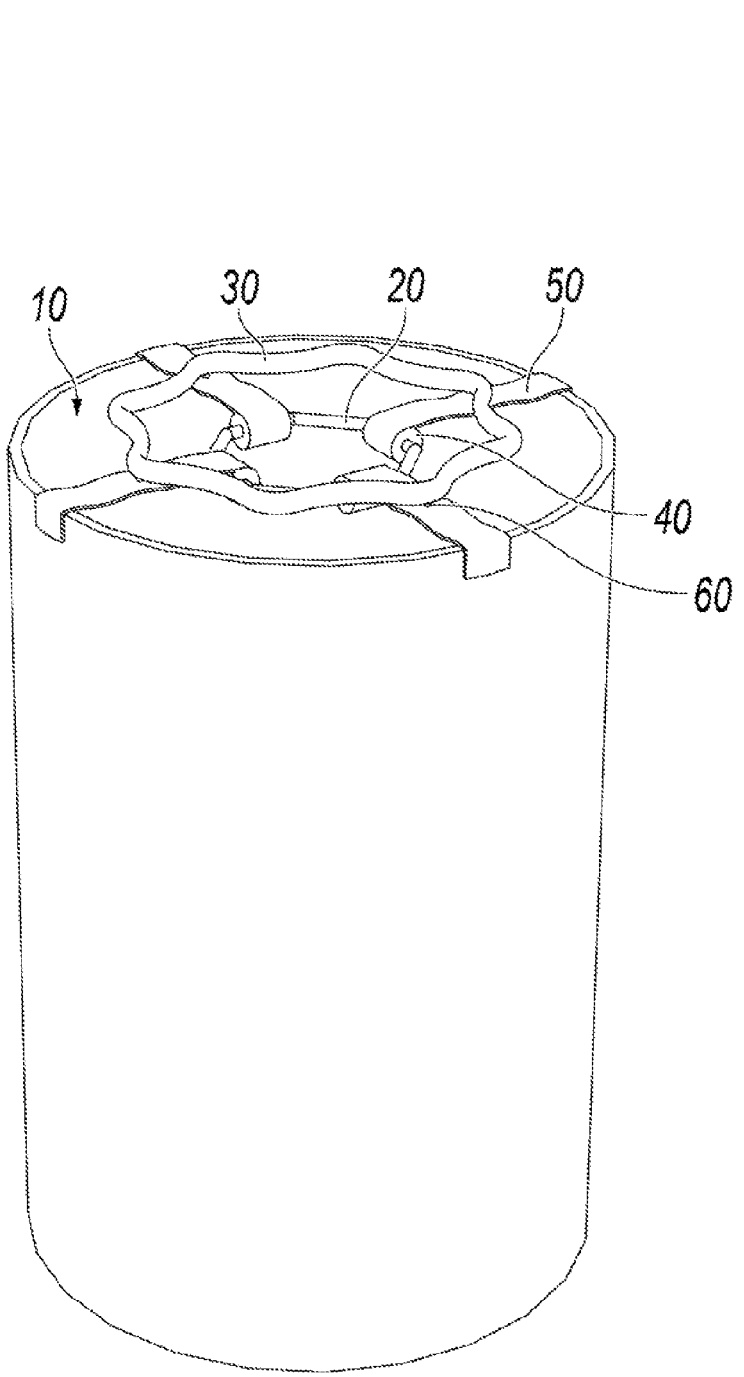
FIG. 1 is a perspective view of a preferred embodiment of a vase brace attached to a flower vase.

1 Vase brace, preferred embodiment
10 Opening of vase
20 Lower ring, preferred embodiment
22 Lower ring, first alternate embodiment
24 Lower ring, second alternate embodiment
30 Upper ring, preferred embodiment
32 Upper ring, first alternate embodiment
34 Upper ring, second alternate embodiment
40 Spool
50 Adhesive tape
60 Upper ring adhesive dot

DETAILED DESCRIPTION OF THE INVENTION

FIG. 1 shows a perspective view of a vase brace as it would be used in a typical flower vase. Flower vases have a bottom, which can be circular, polygonal or irregular in shape. Rising from and joined to the bottom is at least one sidewall. A vase with a circular or irregular bottom will have one sidewall rising therefrom. A vase with a polygonal bottom will have multiple sidewalls joined to each other and rising from the bottom. All sidewalls have a top edge not connected to anything and defining an opening of the vase. The opening of the vase will also be circular, polygonal or irregular in shape. Regardless of the shape, the opening of the vase will have a center and a diameter.

Figure 10:
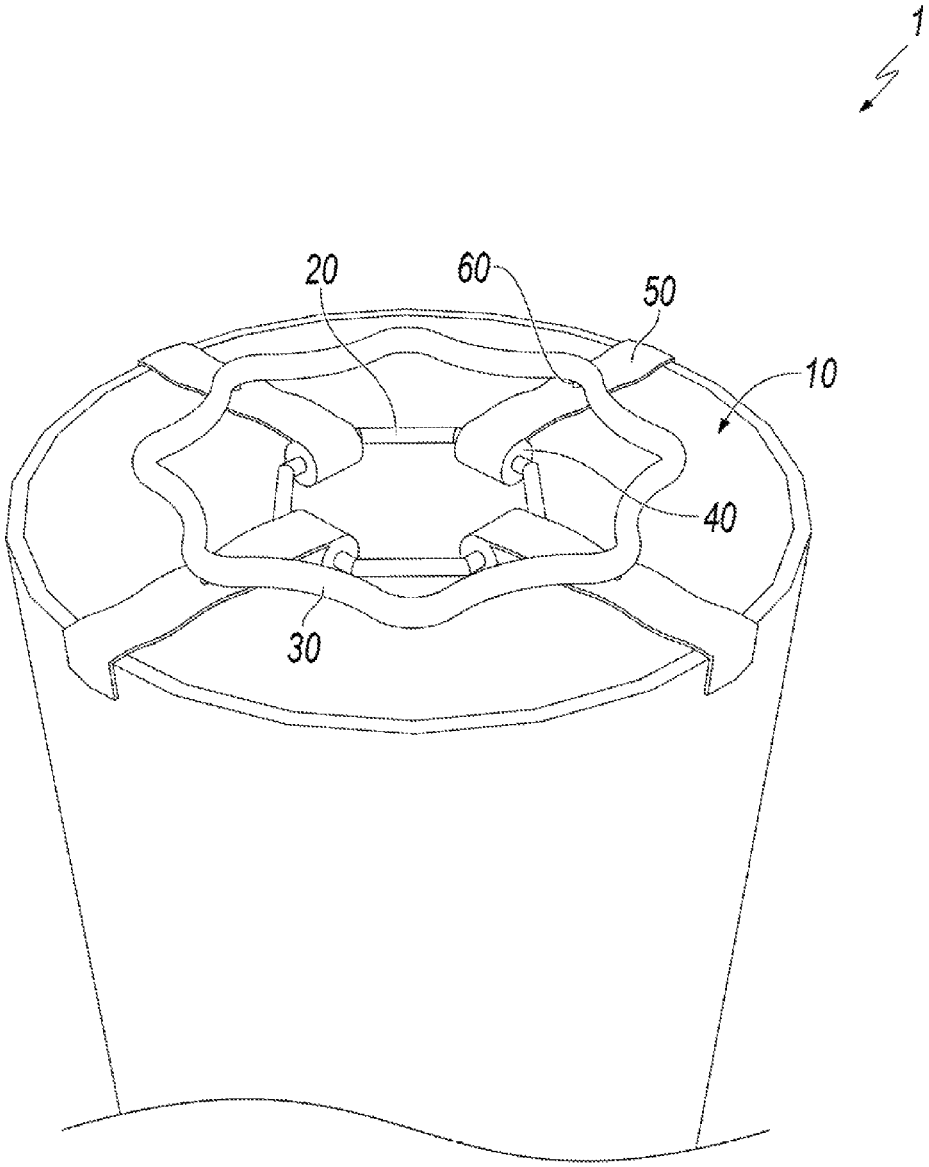
FIG. 10 is a close-up perspective view of a preferred embodiment of a vase brace attached to a flower vase, without flowers.

A preferred embodiment of the lower ring 20 comprises an octagon with spools 40 of adhesive tape set on every other side of the octagon. In the example shown, there are four spools 40. It is possible to include more or fewer spools depending on the user's design choice. Here, the four spools 40, dispense lengths of transparent adhesive tape 50 across the vase opening 10. The lengths of adhesive tape 50, upper ring 30 and lower ring 20 together subdivide the vase opening 10 into nine compartments. Each compartment can support flower stems or other decorative floral elements. Adding more spools would create more, and smaller, compartments. Affixed to and depending to an underside of each upper ring 30 is an adhesive dot 60. In this illustration there are four adhesive dots, one for each length of adhesive tape. The adhesive dots are strong enough to secure the upper ring to the lower ring, but weak enough to be removed when the arrangement is dismantled. FIG. 10 shows the vase brace in a vase without flowers.

Figure 8:
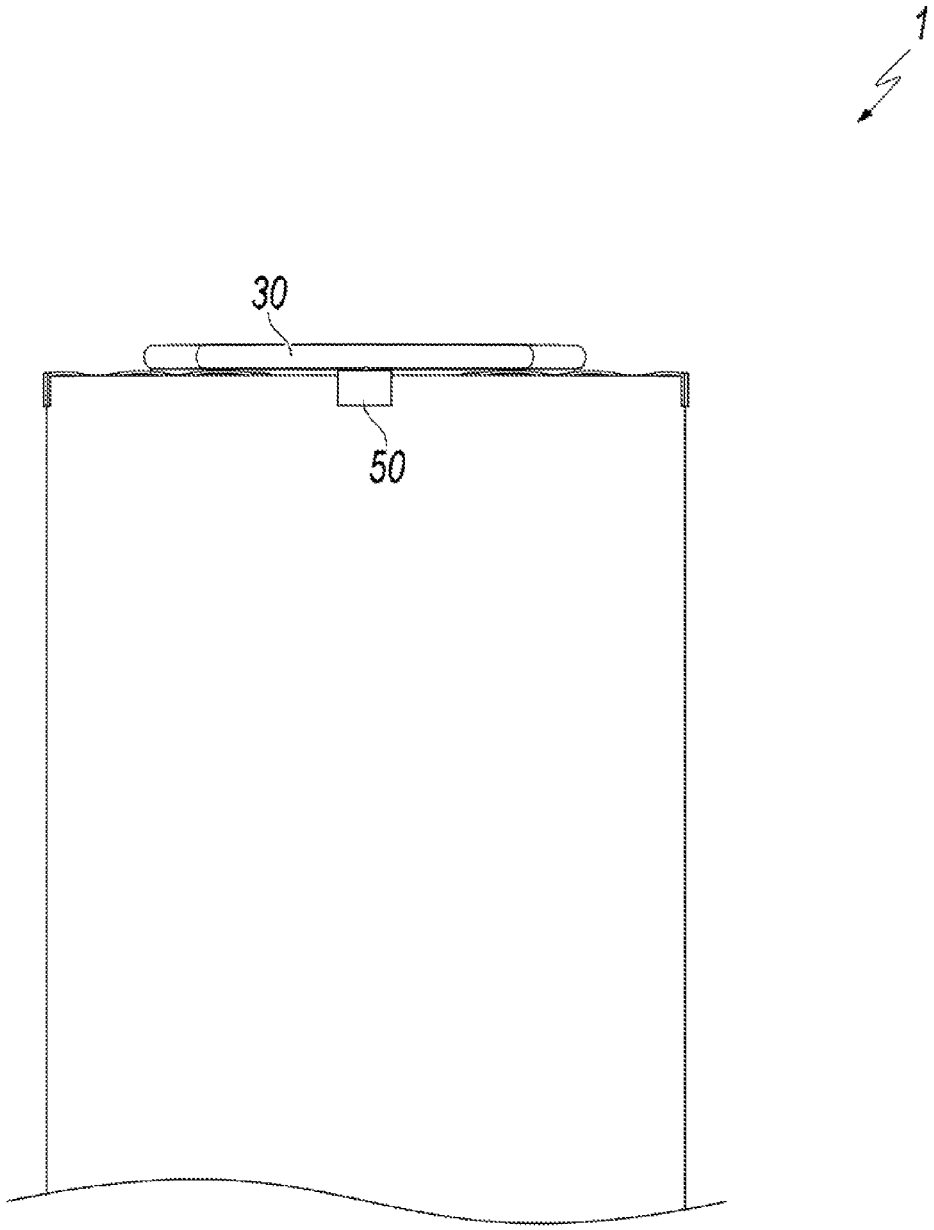
FIG. 8 is a side view of a vase brace attached to a flower vase. The lower ring is present but not shown in this view.
Figure 9:
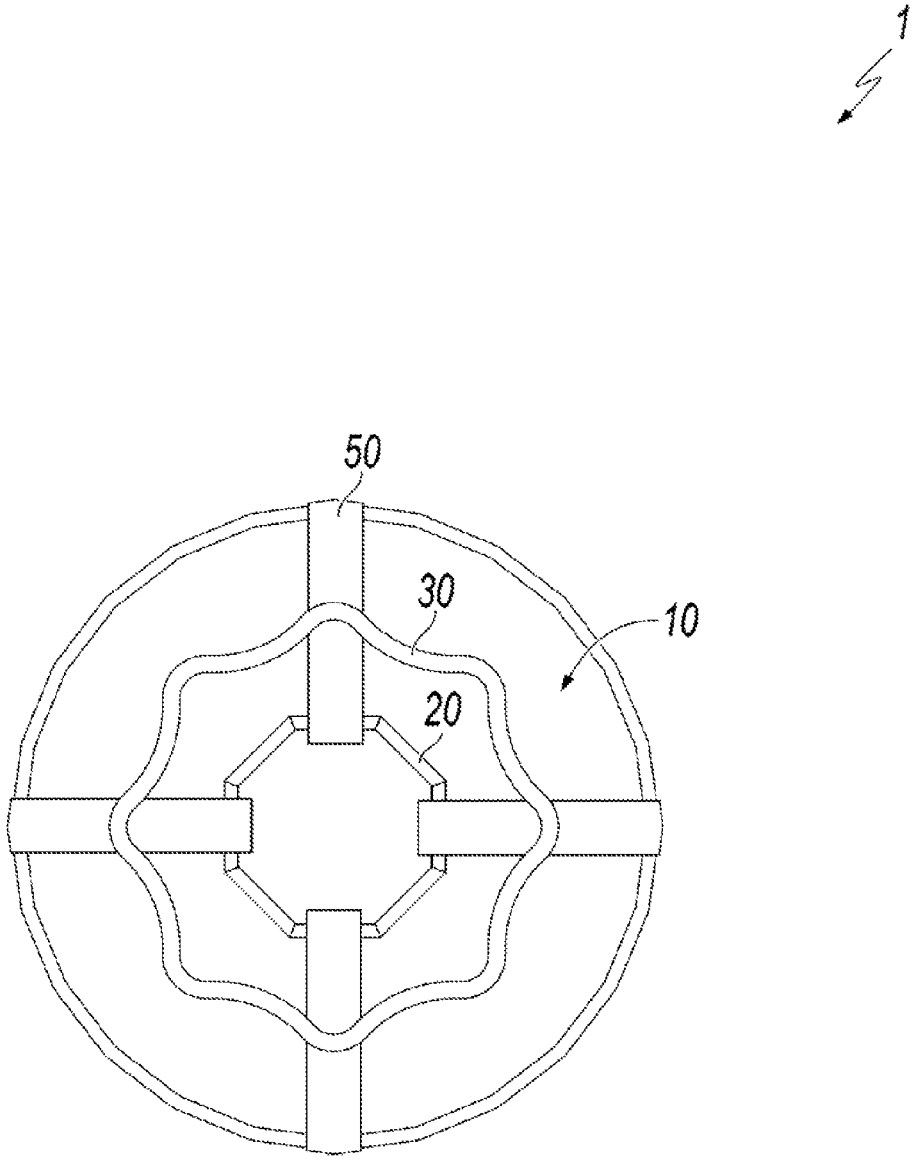
FIG. 9 is a top view of a preferred embodiment of a vase brace attached to a flower vase.

FIG. 8 shows how the vase brace appears from the side. An upper ring is visible above the level of the opening of the vase. In a preferred practice, the spools of adhesive tape are pulled long enough to cross the opening of the vase, but with slack, thereby suspending the lower ring below the level of the vase when viewed from the side. The adhesive tape is can be pulled more tautly if the user chooses to make the lower ring visible.

Figure 2:
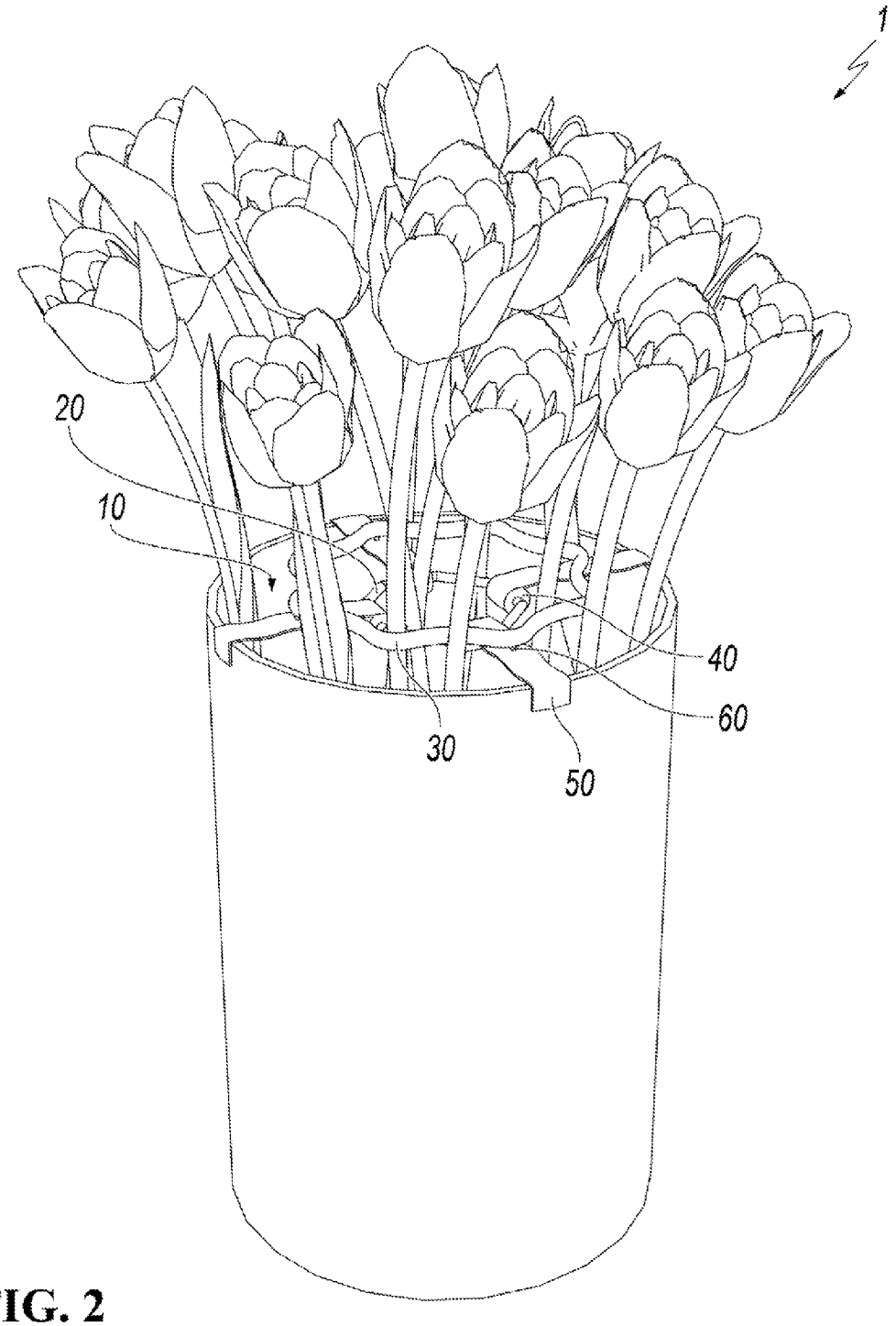
FIG. 2 is a perspective view of a preferred embodiment of a vase brace attached to a flower vase, with flowers supported therein.
Figure 3:
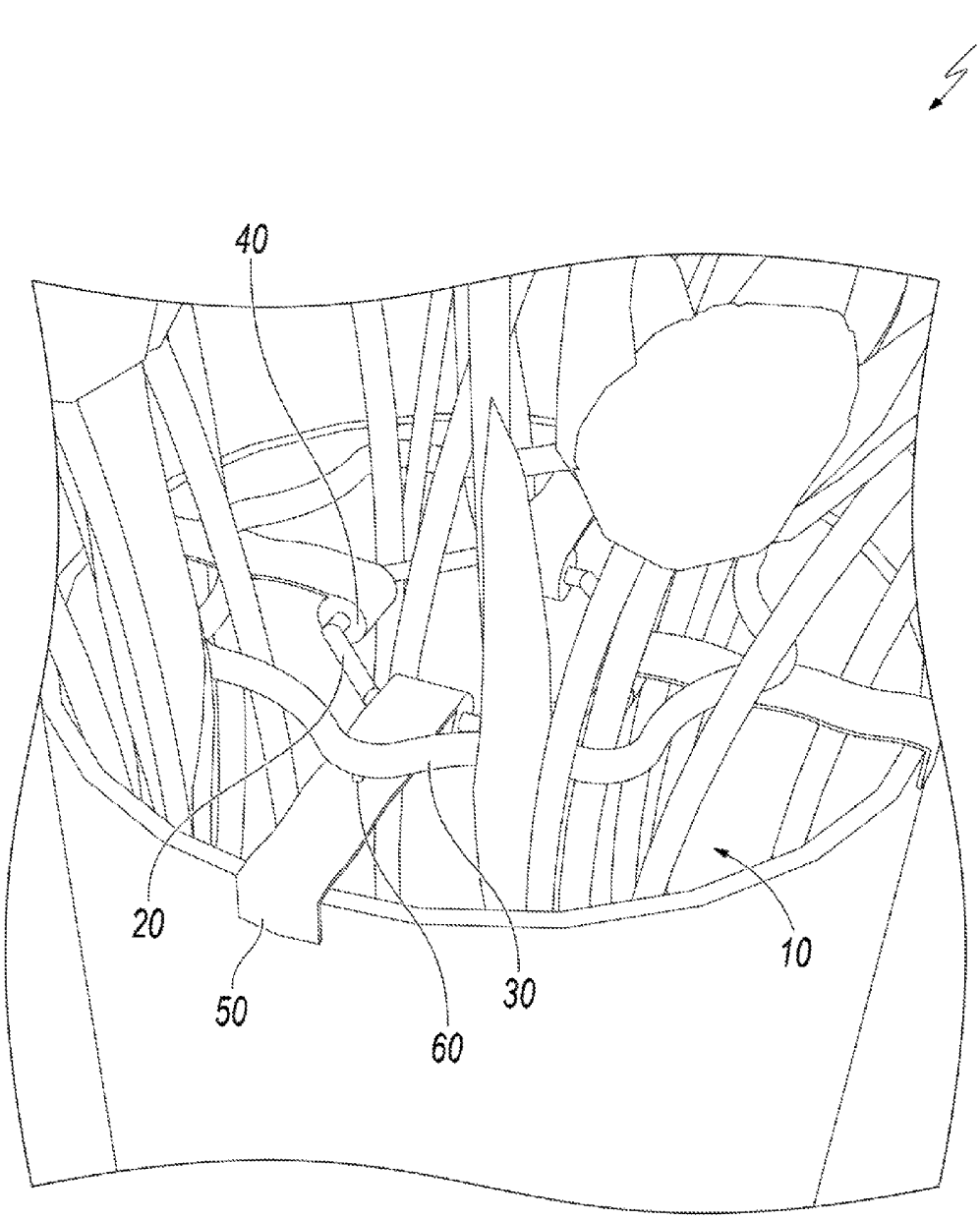
FIG. 3 is a close-up perspective view of a preferred embodiment of a vase brace attached to a flower vase, with flowers supported therein.
Figure 4:
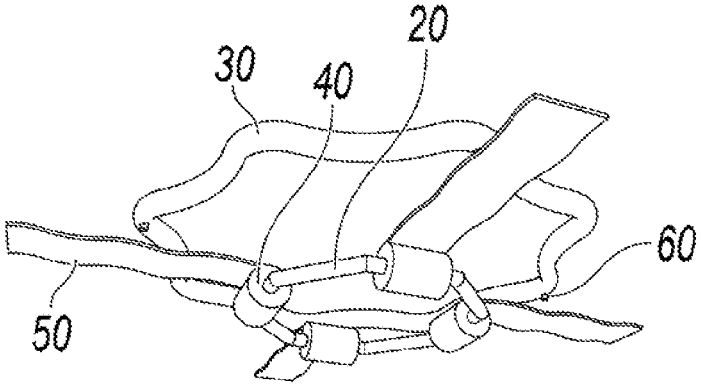
FIG. 4 is a perspective and exploded view of a preferred embodiment of a lower ring, an upper ring, spools, upper ring adhesive and adhesive tape.
Figure 5:
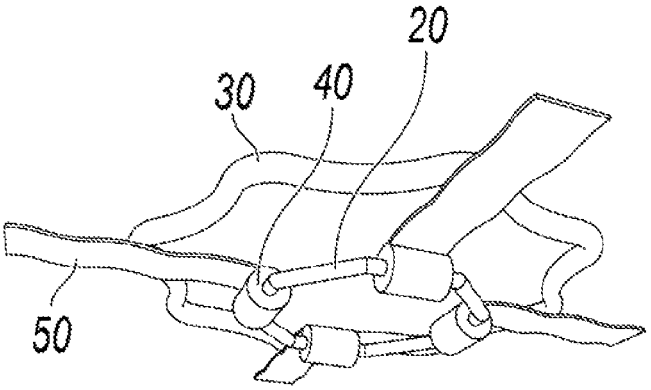
FIG. 5 is a perspective view of a preferred embodiment of a lower ring, an upper ring, spools and adhesive tape.
Figure 6A:
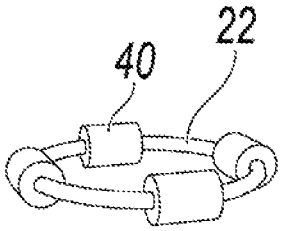
FIG. 6A is a perspective view of a first alternate embodiment of a lower ring.
Figure 6B:
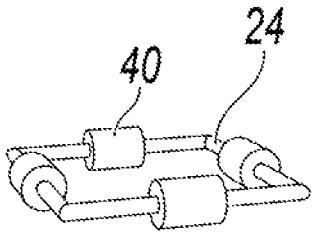
FIG. 6B is a perspective view of a second alternate embodiment of a lower ring.
Figure 7A:
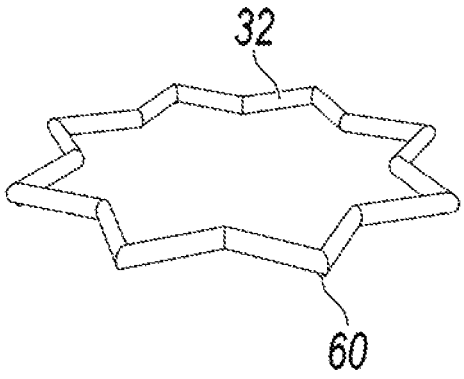
FIG. 7A is a perspective view of a first alternate embodiment of an upper ring.
Figure 7B:
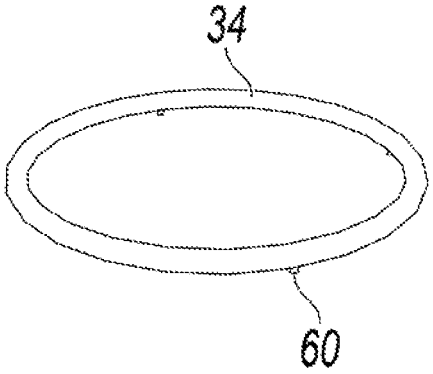
FIG. 7B is a perspective view of a second alternate embodiment of an upper ring.
Figure 11:
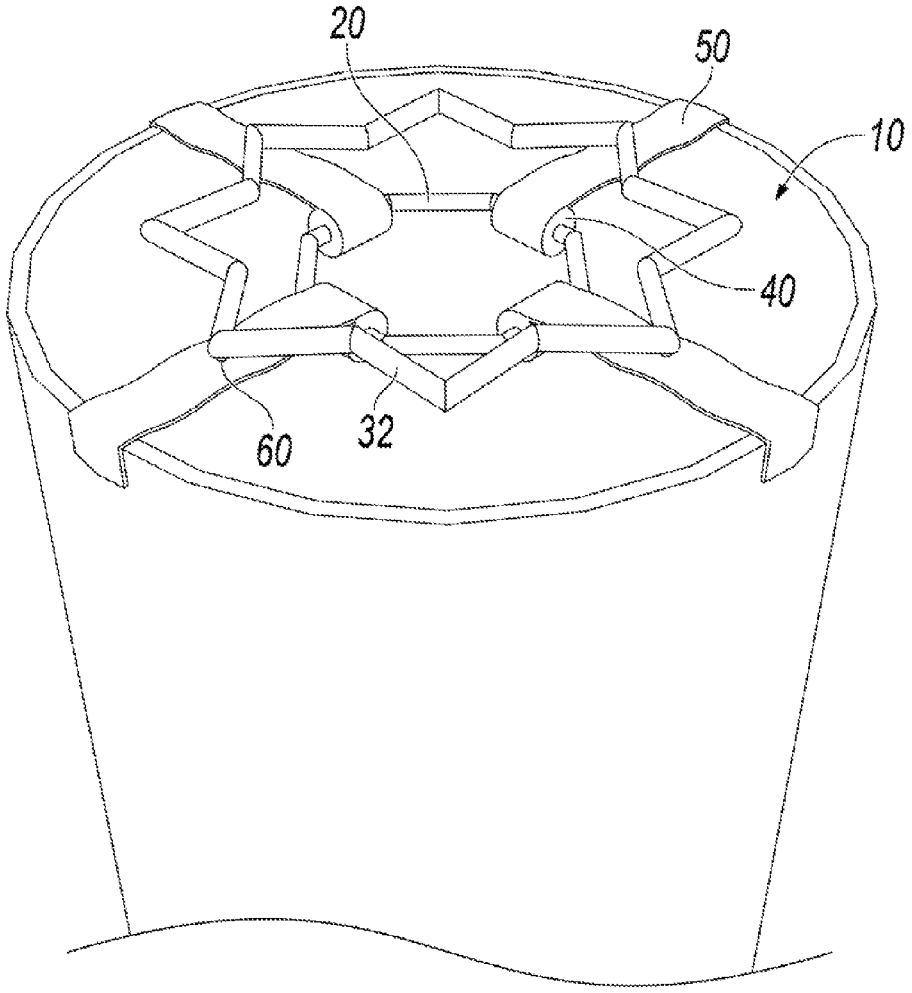
FIG. 11 is a close-up perspective view of a vase brace having a preferred lower ring embodiment and a first alternative upper ring embodiment.
Figure 12:
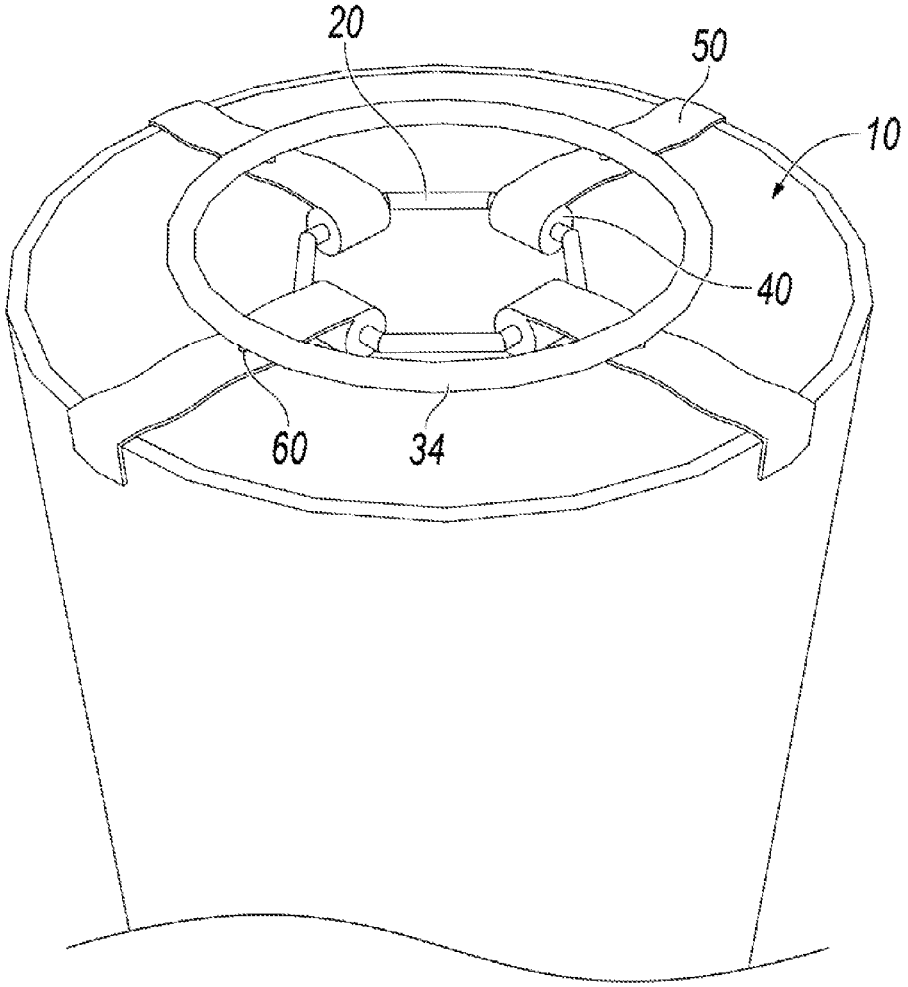
FIG. 12 is a close-up perspective view of a vase brace having a preferred lower ring embodiment and a second alternative upper ring embodiment.

FIGS. 2 and 3 show flowers inserted into the compartments of the vase brace. The rigid rings 20, 30 and semi-rigid adhesive tape 50 support the stems in an upright position. FIGS. 4, 5, 6A and 6B show a close-up view of several embodiments of the lower and upper rings, as they would be seen without a vase. FIGS. 4 and 5 show the preferred embodiments of the lower 20 and upper 30 rings. FIG. 6B shows a second alternate embodiment 24 of the lower ring, a square. In the preferred and second alternate embodiments, the spools 40 can only slide laterally along the short sides of the octagon or square they cannot further shift. FIG. 6A shows a first alternate embodiment wherein the lower ring 22 is a circle. As circles have no sides, the spools can be moved therearound to dispense lengths of adhesive tape in the direction of the user's choosing. This allows the user to customize the size and position of compartments for a particular arrangement. FIGS. 7A and 7B show two alternate shapes for the upper ring. FIGS. 11 and 12 show how those alternate upper rings appear when assembled into a completed vase brace.

Preferably, the upper ring and the lower ring are manufactured from a transparent and rigid thermoplastic material. The diameter can be varied by those of ordinary skill in the art, but is preferably 0.31 cm. The width of the spools and the adhesive tape they dispense can also be varied by those of ordinary skill in the art but is preferably 0.62-1.27 cm. The width of the spool should be the same as the width of the adhesive tape.

I claim:

1. An apparatus for invisibly supporting flowers in a center of an opening of a vase having a bottom, at least one sidewall rising from the bottom and having edges, the edges defining the opening with a circumference, comprising:

a. A lower ring of transparent material having a circumference smaller than an opening of a vase for positioning in the center of the opening of the vase;

b. A plurality of spools evenly disposed around the circumference of the lower ring, each such spool wound with a length of transparent adhesive tape, each such length of adhesive tape having an underside coated with adhesive and a non-adhesive top side;

c. An upper ring of transparent material having a top side, an underside, and a circumference larger than the lower ring and smaller than the opening of the vase; and d. A plurality of adhesive dots corresponding to the plurality of spools evenly disposed around the circumference of the underside of the upper ring, wherein:

e. Each length of transparent adhesive tape unwinds from its spool on the lower ring, crosses the opening of the vase and selectively adheres to a sidewall of the vase, thereby creating a first set of grid lines subdividing the opening of the vase for supporting flowers therebetween, and wherein further each adhesive dot selectively adheres the upper ring to a corresponding top side of a length of adhesive tape crossing the opening of the vase, thereby creating an additional set of grid lines for supporting flowers therebetween.

2. The apparatus of claim 1, wherein the transparent material is thermoplastic.

3. The apparatus of claim 2, wherein the lower ring is a polygon.

4. The apparatus of claim 3, wherein the lower ring is a square.

5. The apparatus of claim 3, wherein the lower ring is an octagon.

6. The apparatus of claim 2, wherein the lower ring is a circle.

7. The apparatus of claim 2, wherein the upper ring is a floret.

8. The apparatus of claim 2, wherein the upper ring is a star.

9. The apparatus of claim 2, wherein the upper ring is a circle.

* * * * *